US006119417A

United States Patent [19]

Valverde et al.

[11] Patent Number: 6,119,417

[45] Date of Patent: Sep. 19, 2000

[54] SLOPED CONCRETE ROOF SYSTEMS

[75] Inventors: Rene L. Valverde, deceased, late of Coral Gables, by Hector R. Valverde, personal representative; Anuca Valverde; Hector R. Valverde, both of Coral Gables, all of Fla.

[73] Assignee: Concrete Roof Systems, Inc, Coral Gables, Fla.

[21] Appl. No.: 08/872,006

[22] Filed: Jun. 9, 1997

Related U.S. Application Data

[63] Continuation of application No. 08/497,780, Jul. 3, 1995, abandoned, which is a continuation-in-part of application No. 08/275,508, Jul. 15, 1994, abandoned.

[51] Int. Cl.[7] ..... E04C 5/08

[52] U.S. Cl. ..... 52/223.7; 52/91.1

[58] Field of Search ..... 52/223.7, 91.3, 52/91.1, 91.2, 223.6, 223.1, 223.8, 223.9, 223.11

[56] References Cited

U.S. PATENT DOCUMENTS

| | | | |
|---|---|---|---|
| 2,139,623 | 12/1938 | Marston | 52/91.3 |
| 2,476,135 | 7/1949 | Colburn | 52/91.2 X |
| 3,319,387 | 5/1967 | Stewing et al. | 52/223.7 |
| 3,621,624 | 11/1971 | Gustafson | 52/91.1 |
| 3,638,371 | 2/1972 | Liska | 52/91.3 |
| 3,886,699 | 6/1975 | Bergmann | 52/91.1 |
| 3,898,776 | 8/1975 | Cox et al. | 52/91.2 X |
| 4,674,242 | 6/1987 | Oboler et al. | 52/91.2 |
| 4,694,629 | 9/1987 | Azimi | 52/223.7 X |
| 5,148,643 | 9/1992 | Sampson et al. | 52/200 |

*Primary Examiner*—Beth Aubrey
*Attorney, Agent, or Firm*—Oltman, Flynn & Kubler

[57] ABSTRACT

A roof structural system for use in all building types (i.e. single family homes, apartment buildings, condominiums, churches, etc.) consisting of precast, prestressed and/or post-tensioned concrete elements assembled in the field and complemented with poured in place concrete. These elements may consist of slabs, beams, soffits and/or any other structural component susceptible of being pre-programmed and precast in other than the job site.

14 Claims, 6 Drawing Sheets

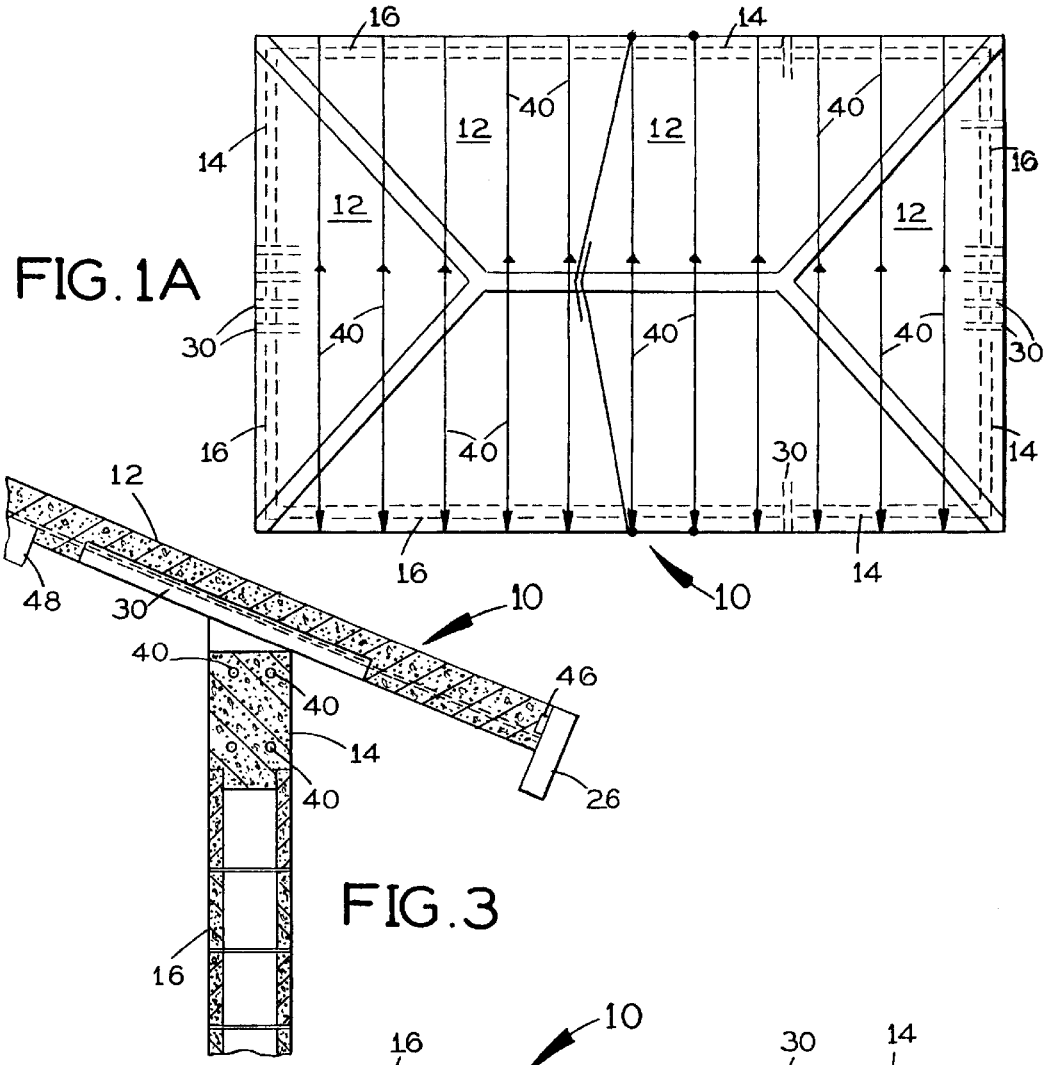
FIG. 1A
FIG. 3
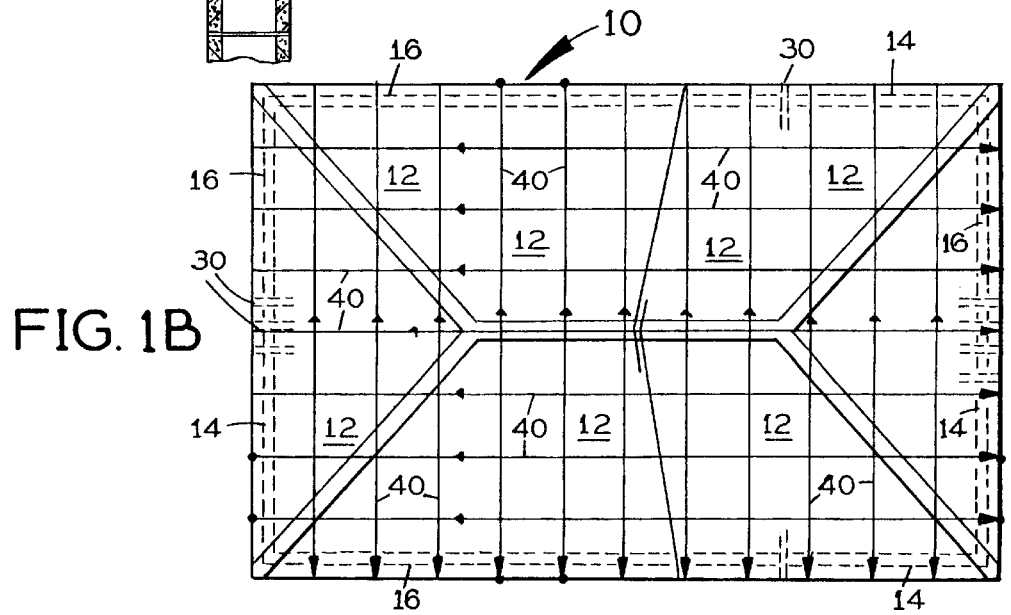
FIG. 1B

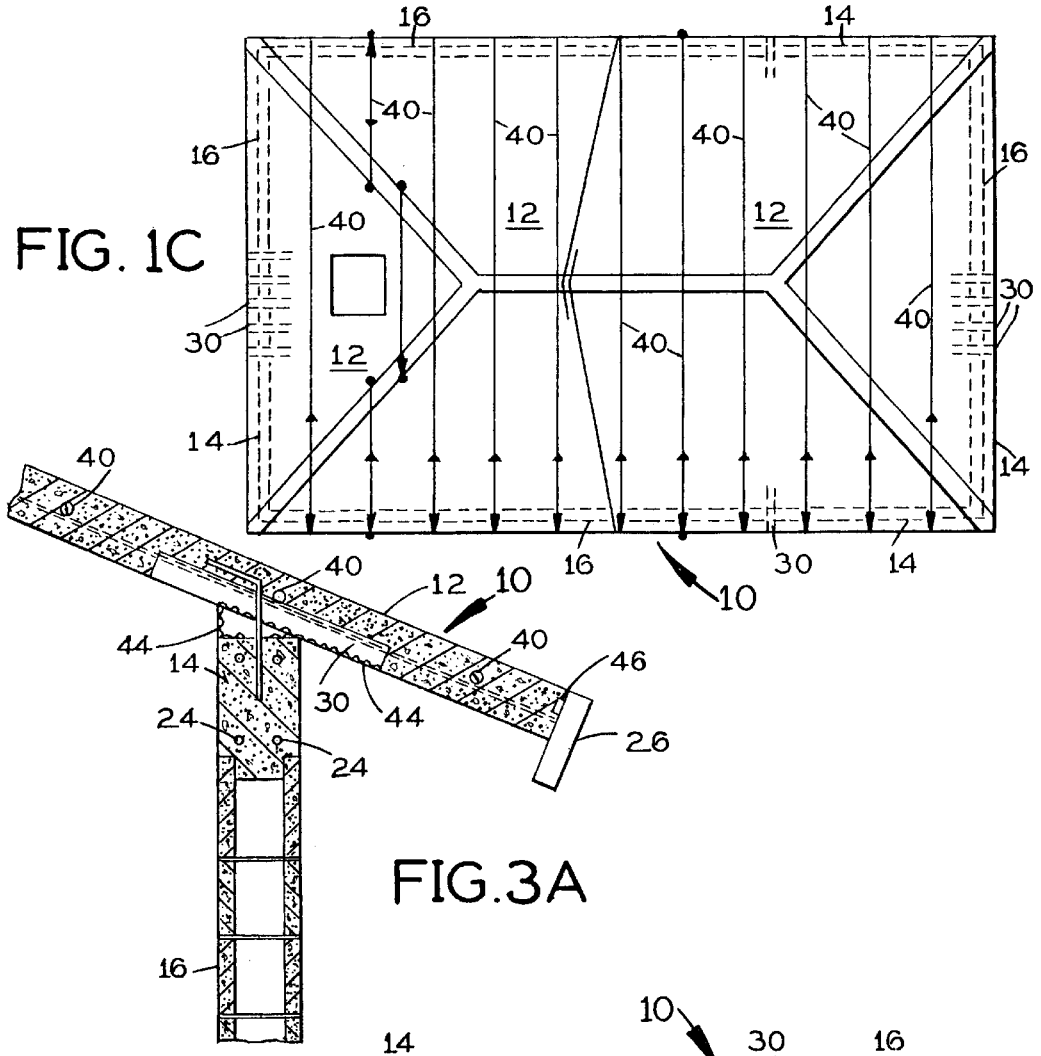
FIG. 1C
FIG. 3A
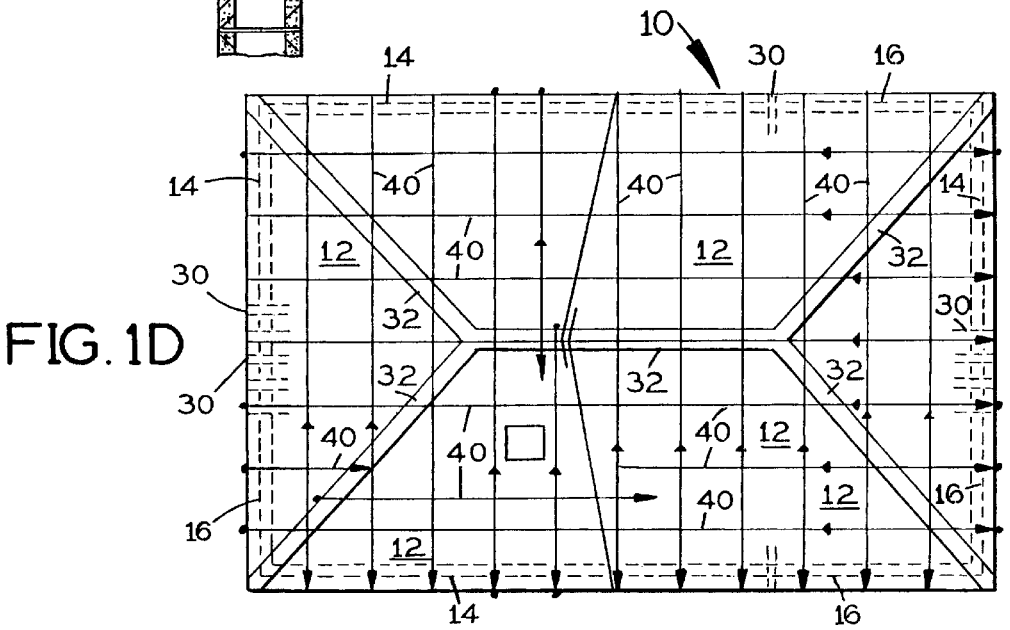
FIG. 1D

SLOPED CONCRETE ROOF SYSTEMS

FILING HISTORY

This application is a continuation of application Ser. No. 08/497,780, filed Jul. 3, 1995 now abandoned. This application is a continuation-in-part of application Ser. No. 08/275,508 filed on Jul. 15, 1994 now abandoned.

BACKGROUND OF THE INVENTION

This invention relates to concrete roof structural systems which are post-tensioned or pre-stressed and which are erected into a dual or multiple sloped shape using either precast panels or a monolithic poured-in-place concrete slab. In almost all cases, it consists of wood trusses assembled with 2"×4" or 2"×6" (nominal dimensions) structural grade wood sections and covered with no less than ⅝" plywood sheathing. Many years ago, before the wood truss came into being, this system consisted of wood rafters covered with wood boards. At present most of these roofs remain in place, but all of them are still exposed to the fury of hurricanes, the threat of fires and the hunger of termites, let alone the devastating effect of tornadoes. In addition, the waterproofing qualities of these roofs are affected after a relative few years (in many cases less than 15) and the roofing has to be replaced at the corresponding cost.

Some thirty five years ago the marketplace mentality for multi-story buildings, gymnasiums, warehouses and big span structures in general was geared around the structural steel frame, the open web steel joist, the steel deck, the gypsum board and the poured in place gypsum roof. Around 1965 the reinforced concrete structure became economically feasible, and as the contracting sector learned about the new system it rapidly penetrated the market. Today almost all these types of structures are geared around the many forms and systems of the reinforced concrete.

However, for almost all dwellings the wood truss as the roof structure has remained intact. No sensible changes have taken place in this sector of the building market. With Hurricane Andrew thousands of dwellings literally lost their roofs, and the Building Code had to be revised with the only system at hand, the wood truss and plywood sheathing.

Secular inflation has affected the building industry all along. As wood demand increased, its price and final cost increased. Year after year its price in the marketplace has increased from a very affordable one to a relatively expensive one. Parallel to it, the wood structural system cost for dwellings has also increased, and cost is expected to continue.

Quality comparison of the two systems, wood and concrete, gives the reinforced concrete structure concept the hands down advantage over the wood structural systems.

Structurally, the systems disclosed herein fully comply with the South Florida Building Code. The attached drawings represent a typical dwelling plan and sections describing some of the different structural details that occur at the roof level.

SUMMARY OF THE INVENTION

Basically the invention includes precast or prestressed roof slabs that are precast with modular width. These slabs are erected and supported by the corresponding formwork at one end, overhanging beyond the supporting tie beam at the other end. These slabs are temporarily supported by heavy adjustable post shores, braced between each other and the building walls, and bearing on compacted fill or the floor slab below, aided if necessary by additional wood planks so as to uniformly distribute the dead load of the roof system.

In many cases, however, the geometry of the roof will allow the roof loads to be carried in compression from the hips to the ridge and from there through the slab panels, working as a diaphragm, that will absorb and carry the stresses generated by those loads into the wall system below.

For safety reasons, and in order to secure their position, each slab may be welded between each other and to the wall system below through the use of steel inserts, exposed reinforcing and/or steel angles bolted to the walls and the slabs. Once the precast slabs are erected, all plumbing penetrations and electrical installations shall be in place, (no metallic conduits would be allowed over the precast slabs) after the installation of the welded wire fabric is accomplished.

Although in some cases the use of a reinforcing fabric may not be structurally required, nevertheless it is contemplated that it will restrain the volumetric changes in the roof slab due to changes in humidity and temperature, precluding the roof from developing surface cracks that ultimately may be conducive to possible water leaks.

Precast fascia are attached to the end of the precast slabs by temporary use of bolts. The line and level of the fascia is accomplished by the use of piano wires attached to the corners of the roof. Similarly the lines generated at the ridge, hips and valleys are obtained. After the reinforcing mesh is in place, all lines are installed and the thickness of the topping is obtained, the system is ready for the secondary pour of cement.

In pouring the finishing concrete portion of the roof, the shotcrete method is used. The recommended mortar mixture should have a structural strength not higher than 3,000 psi. at 28 days. There are two main reasons for this. Cement is a man made material susceptible to relatively high volumetric changes due to humidity changes. The lesser the cement is to total volume ratio in a concrete mixture, the lesser volumetric changes will occur in the concrete after it reaches its final setting time. The second reason is its nailable capability. The higher the concrete strength, the harder it becomes attaching any roofing system to it if it has to be nailed. If, from a structural standpoint, no great bending or shear stresses are developed in the topping, then there is no valid reason that a high strength mortar mixture would be required.

In order to preclude the slab from developing thermal cracks during the curing process it is also advantageous that addition in the proper amount of a non-shrinkable admixture to the mortar mixture be made. This will help secure the water-proofing qualities of the roof.

The secondary pour could be finished smooth or with a light brush texture.

So far a structural system consisting of pre-stressed concrete panels finished with a concrete topping has been described. In many cases it is not necessary to include a concrete topping in order to accomplish the same results. This would entail the elimination of the topping and in lieu of it, filling all the longitudinal joints between panels, the valleys, the hips and the ridges with a proper low water cement ratio mortar as shown in the figures. The invention includes two methods of temperature reinforcement. The temperature reinforcing is necessary to eliminate all possible cracks in the surface of the concrete that may lead to water leakages. The first method consists of the introduction of reinforcing steel bars located transversely to the main span of these panels in numbers and sizes sufficient to absorb any possible strain due to temperature and or humidity changes. The temperature reinforcement is welded solid to a clip angle located on each side of the panel and connected to one another through a steel plate solidly welded to the clip angles.

The second method includes embedding a plastic tube using the accessory attachment shown in the figures transversely through the concrete panel and connecting them at the construction site with additional plastic tubes located at the panel joints, inserting in them a temperature cable. After all joints, hips, valleys and ridges are filled to the final roof lines and the proper strength is accomplished, then the temperature cables are post-tensioned, cut and finished to surface with the proper amount of mortar. This way the whole roof surface is compressed to the point that no possible water leakage may result.

For many situations, a third method is provided which does not involve assembling pre-cast panels. Instead, a concrete slab is poured-in-place and then post-tensioned, and may be either monolithic or cast in two or more parts.

The entire roof may be cast in forms constructed of plywood or other form materials, and supported using post-shores or other supporting structures. Polystyrene panels are optionally used as form material and would automatically provide the necessary R-factor to satisfy the energy code. Steel post-tension cables are placed over the entire roof and spaced as required by the structure to interconnect all ridges and hips in compression. These post-tension cables can be placed longitudinally across the ridge, from one edge of the roof to the opposing edge, and can be complemented with steel reinforcement to provide a structurally sound system. Alternatively, the post-tension cables can be placed both longitudinally and transversely from edge to opposing edge of the roof perimeter, over the various planes, slopes, ridges and hips of the roof, and complemented with steel reinforcement, to provide the strongest structural configuration. The structure produced by this method, if designed and post-tensioned properly, will prevent cracks on the concrete roof slab and make the slab totally waterproof.

In certain cases, the roof characteristics may require that some or all post-tension cables not be post-tensioned from one edge of the poured-in-place slab to the opposing edge. In these cases, the post-tension cables are placed to connect the edge of the slab, or any point in the slab, with another certain point in the slab where there may be a different plane or slope, or even to a point within the same plane.

Additional steel reinforcement may be placed as needed, and passageways are provided for future use for all electrical and plumbing requirements. Along the perimeter of the roof overhang, and perpendicular to it, wood or foam forms are positioned as often as required to create ventilation sleeves between the outside of the overhang and the interior of the building. Screens can later be placed over the exterior ends of these ventilation sleeves. Additional ventilation openings can be provided, if necessary, on the ridge or at other locations. In order to create a tie down connection between the supporting structural elements (perimeter tie beam or structural beam) and the poured-in-place concrete roof, steel re-bar dowels with lateral movement capability (see detail) protrude from the supporting elements and are embedded into the poured-in-place concrete slab. A friction barrier is provided (for example: roofing paper) between the top of support and poured roof slab, in order to allow for lateral movement when post-tensioning occurs. A pressure treated wood insert is positioned along the entire roof perimeter to receive fasteners for attaching a conventional wood fascia after the concrete slab is cured.

Concrete is then poured over the entire formed roof surface using a pump, or the shot crete method, and forms a monolithic connection between the entire roof area and the perimeter structural support system. After sufficient curing time has elapsed, all cables are post-tensioned, and the supporting shoring is removed. This poured-in-place method may eliminate all welding, all joints and all steel angles, as well as the need for any additional secondary pouring.

In cases where the roof slab is not monolithically formed and/or poured, all cold joints are fitted with a low water to cement ratio concrete before tension is applied to post-tension cables. An additional level of waterproofing is optionally attained with an asphalt-based or other type of sealer. A roof system is provided according to any of the above methods, which may be sealed or waterproofed using Cemflex™ or Karrnac AF 220™ or a one ply roofing water proofing system.

Horizontal Thrust

The diaphragm action of the roof panels, or of the entire roof slab in the case of the poured-in-place method, generates a horizontal thrust that tends to reach into the strongest points of the wall system at the tie beam level and which are located in general at the corner of the buildings. Depending on the size of the building, the tie beam reinforcement may or may not carry this horizontal thrust. If necessary, the addition of post-tension cables embedded in the tie beam, or post-tension cables between two adjacent and/or opposite walls, panels, and/or slopes of a poured-in-place concrete slab will satisfy the strength requirement developed by the system. High strength cables may be used for post-tensioning the whole roof structure for uplift loads that may be produced by a hurricane or tornado.

Ventilation

Ventilation of the attic space is accomplished by leaving an empty space at the underside of the panel or of the concrete slab in the case of the poured-in-place method that will connect the exterior of the building with the attic space. In order to be able to attach the corresponding screens to the underside of the overhang at the exterior wall of the building, additional inserts are left in the slab so as to be able to attach the screen to them.

Fascia

There are two methods of attaching the fascia member to the roof system:

In buildings where the specifications call for the attachment or use of wood fascia members, they may be attached to the roof system by the use of a wood insert at the edge of the roof overhang, with nails or screws.

In building with concrete fascias, their attachment to the roof 10 system may be accomplished by leaving threaded inserts along the edge of the roof panels and attaching the fascia to them through the use of bolts.

Structural Advantage

When compared with reinforced concrete as a structural material, wood is a very soft and non-durable one. By comparison, its module of elasticity, and durability is small, and its volumetric capacity to changes in humidity renders wood an inferior material to that of reinforced concrete. Given enough time, whenever wood is exposed to the elements, it rots. The durability of concrete is superior to that of wood. Even where wood structures stand today, practically as the only ones in existence, their maintenance in good structural condition is very costly. The cost goes on year after year, and must be considered at the time when a new roofing has to replace an existing one made of wood.

Advantages of Concrete Roofs During Hurricanes and Tornadoes

During a hurricane, wind velocities have been measured to be between 150 and 200 mph. Granted that some of the higher velocities are limited to gusts affecting relatively small areas, but when converting the kinetic energy of air at 170 mph. into comparable pressure at zero velocity, the differential pressure generated between the interior and exterior surfaces of the roof reaches 73 pounds per square foot. The mere opening of a window on the windward side of the storm will easily produce this situation. The devastation of Andrew was a tragic witness to that. No wood trussed structure could have enough strength to support such a pressure. As a consequence the roof structure will totally disintegrate, collapse and blow away.

The structural dead load of a reinforced concrete roof structure could vary between 65 and 75 pounds per square foot. This suggests that even a structural concrete roof must be tied to the structure below it. Provided these conditions are satisfied, it will render a totally monolithic prismatic construction, its roof structure complementing the dwelling's heretofore open boxlike geometric configuration and securing the integrity of the roof and wall structure intact with no damage occurring to any portion of it, when exposed to such conditions.

Fire Hazard Advantages

The presently used wood framing of dwellings constitutes a permanent fire hazard. As wood trusses dry up in the attic of a house it converts itself into a potential powder-keg-like condition ready to blow up at any time. This may happen whenever an old Romex wire installation heats up because a short circuit has occurred, or when the thermostatic relay or control of an air conditioned installation goes bad and the unit keeps heating when the fan stops as in many such cases. The fire statistics of any fire department is a horrifying witness to these occurrences. The high cost of fires, in deaths and material losses, is enormous, even in locations where the rigor of winter does not require installation of constant live-flame oil heaters in dwellings.

The proposed reinforced concrete roof structural system is intrinsically fireproofed. Any fire generated within the dwelling will not feed itself in the roof structure, but will be restrained and limited to the dwelling in question, offering a very small, if any threat to any possible neighboring structure. In addition, the fire would be controlled easier and faster. The roof structure will probably suffer very little, if any damage.

Waterproofing Qualities and Advantages

The addition to the topping pour of the welded wire fabric and the nonshrinkable admixture or any of the previously mentioned reinforcement means or of the transverse and longitudinal post-tension steel cables as in the poured-in-place place-method, will result in a completely waterproofed section. The addition, if desired, of an appropriate concrete curing agent which will serve as a sealer will result in a further guarantee of the completely waterproofed section. The addition, if desired, of two coats of an appropriate sealer will finally guarantee the waterproofing qualities of these systems. With that, the elimination of the traditional built-up roofing system could be attained. To finish the roof, the use of many types of decorative roofing systems including the clay, cement and asphalt tile, metal cladding, stone or wood are possible.

The fact that a properly designed and post-tensioned roof is permanently waterproofed, by itself, and does not rely on a built-up roof for its watertightness, assures that the roof's covering will never have to be removed in order to re-apply a sealer or re-install a new built-up material.

Pest Control Advantages

The pest control industry is a multimillion dollar business. Each year termites practically eat out at many thousands of homes. While other portions of the house are affected, the wood roof structure is the one that concerns us the most when we call a pest control company to put their tent over our house.

Needless to say, termites cannot affect a reinforced concrete structure. When a reinforced concrete roof structure is installed over a dwelling, the potential savings in pest control cost over the years could be measured in thousands of dollars.

Insurance Advantages

The insurance premium that every home owner has to pay to protect his house is based, among other things, on the type of structural frame of the house. Again, any dwelling containing a reinforced concrete roof structure, because of all the advantages heretofore mentioned, will draw a smaller insurance premium bill than those built with the conventional wood structural roof system.

Further objects and advantages of this invention will be apparent from the following detailed description of the presently preferred embodiments which are illustrated schematically in the accompanying drawings.

BRIEF DESCRIPTION OF THE DRAWINGS

FIG. 1*a* is a plan view of a concrete roof constructed according to the poured-in-place method and showing typical edge to edge of perimeter longitudinal post-tension steel cables, typical steel reinforcement and typical ventilation sleeves.;

FIG. 1*b* is a plan view of a concrete roof constructed according to the poured-in-place method and showing typical edge to edge of perimeter longitudinal and transverse post-tension steel cables, typical steel reinforcement and typical ventilation sleeves;

FIG. 1*c* is a plan view of a concrete roof constructed according to the poured-in-place method and showing a combination of edge to edge and non-edge to edge longitudinal steel post tension cables, typical steel reinforcement, typical ventilation sleeves and a typical opening for a skylight;

FIG. 1*d* is a plan view of a concrete roof using the poured-in-place method and a combination of edge to edge and non-edge to edge longitudinal and transverse steel post tension cables, typical steel reinforcement, typical ventilation sleeves and typical openings for skylight and for ridge and slope ventilation.;

FIG. 3 is an elevational, cross-sectional view of a block wall supporting a tie beam and a part of an overhanging prestressed concrete roof panel;

FIG. 3*a* is an elevational, cross-sectional view of a block wall supporting a tie beam and a portion of the poured-in-place post-tensioned concrete slab;

Figure 1:
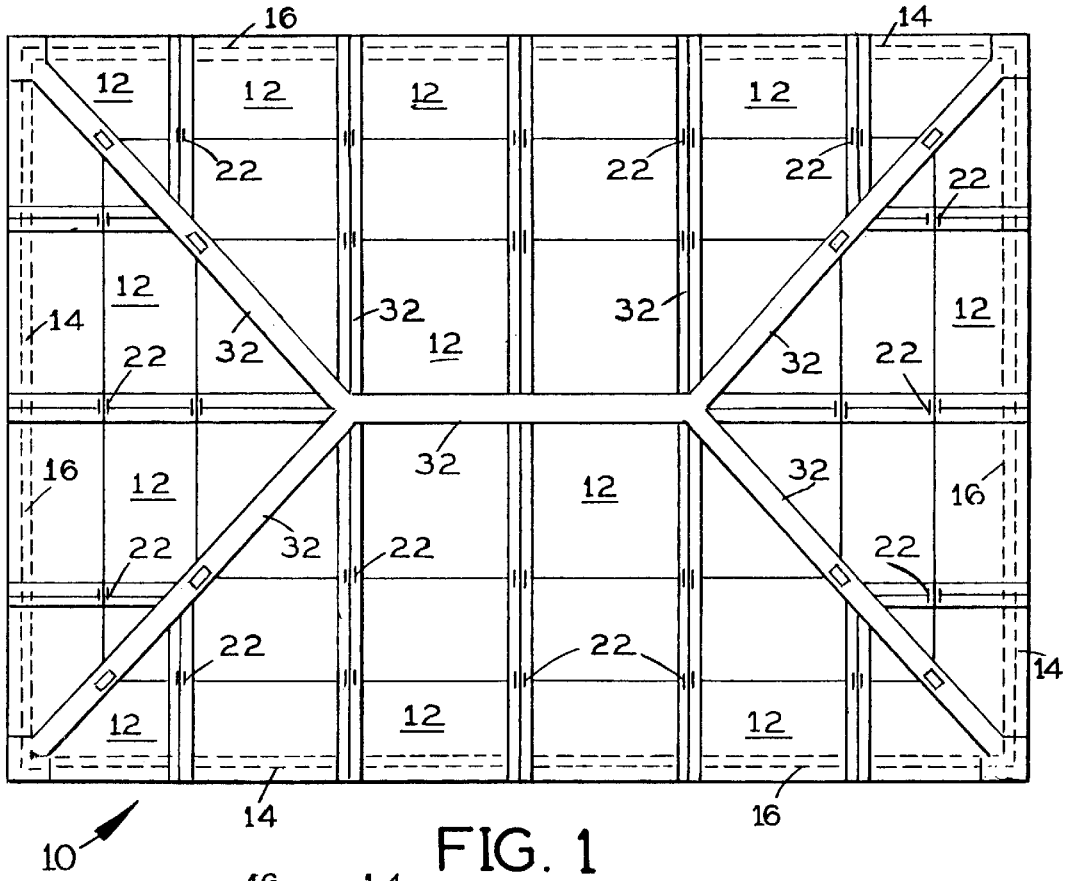
FIG. 1 is a plan view of a concrete roof of precast panels.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Referring now to FIGS. 1–11, FIG. 1 shows a top-down plan view of a concrete roof 10 according to the invention, formed of a plurality of precast roof panels 12 of a modular width that conforms with established or future modular dimensions as pertaining to the building construction industry, or formed of a poured-in-place concrete slab 12 with transverse and/or longitudinal post-tension cables 40.

The concept according to the invention essentially includes a system of precast or prestressed roof panels or slabs 12 that are precast with modular width. These slabs are erected and supported by a corresponding formwork at one end, overhanging beyond the supporting tie beam 14 (FIGS. 3, 4 and 11) at the other supporting tie beam 14 at the other end. These slabs 12 are, during construction, temporarily supported by heavy adjustable post shores, braced between each other and the building walls 16, and bearing on compacted fill or the floor slab below, aided if necessary by additional wood planks so as to uniformly distribute the dead load of the roof system.

In many cases, however, the geometry of the roof 10, seen in FIGS. 1 and 2 will allow the roof loads to be carried in compression from the hips to the ridge and from there through the slab panels 12, working as a diaphragm, that will absorb and carry the stresses generated by those onto the wall 16 system below.

For safety reasons, and in order to secure their position, roof panels 12 may be welded to each other and to the wall 16 system below by means of steel inserts, exposed reinforcing and/or steel angles 22 bolted to the walls and the slabs as seen in FIGS. 4, 5, 6, 7, 9, 10 and 11, showing various weld parts as described below. Once the precast slabs 12 are erected, all plumbing penetrations and electrical installations shall be in place, (no metallic conduits would be allowed over the precast slabs 12) after the installation of the welded wire fabric is accomplished.

In FIG. 1 the concrete roof 10 is seen supported on a wall 16 seen in phantom lines. The wall 16 is contemplated as a conventional concrete block wall, topped where needed with a tie beam 14 over wall 16 openings for doors, windows and the like.

Figure 2:
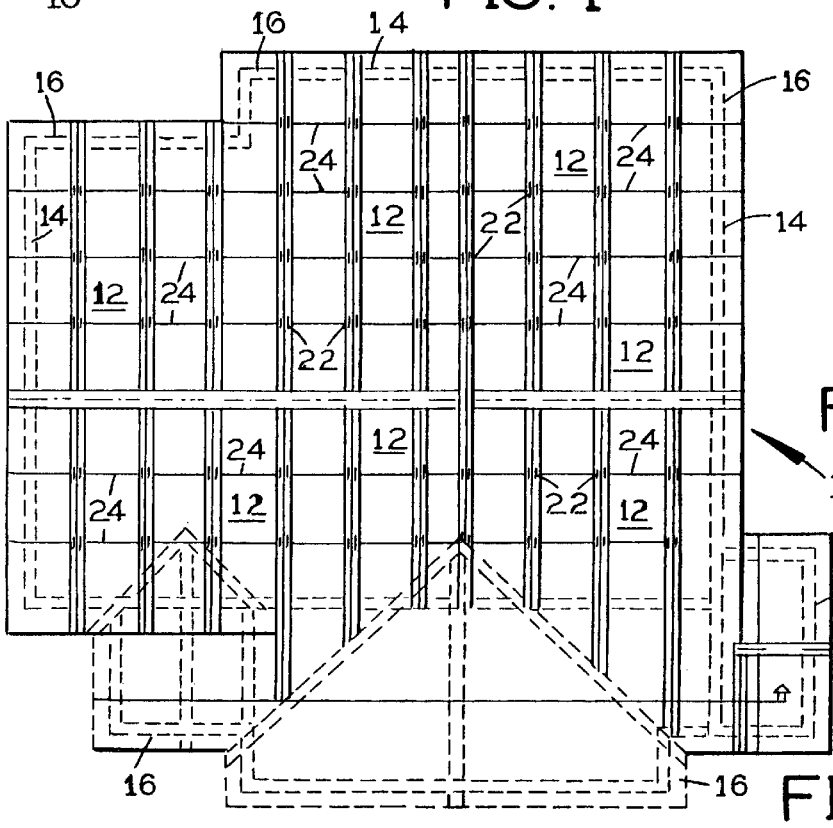
FIG. 2 is a plan view of a concrete roof of prestressed panels.
Figure 2A:
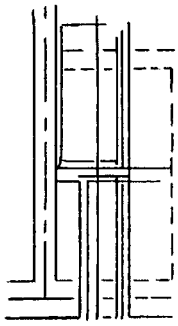
FIG. 2*a* is a fragmentary detail view seen along the line C—C of FIG. 1.
Figure 4:
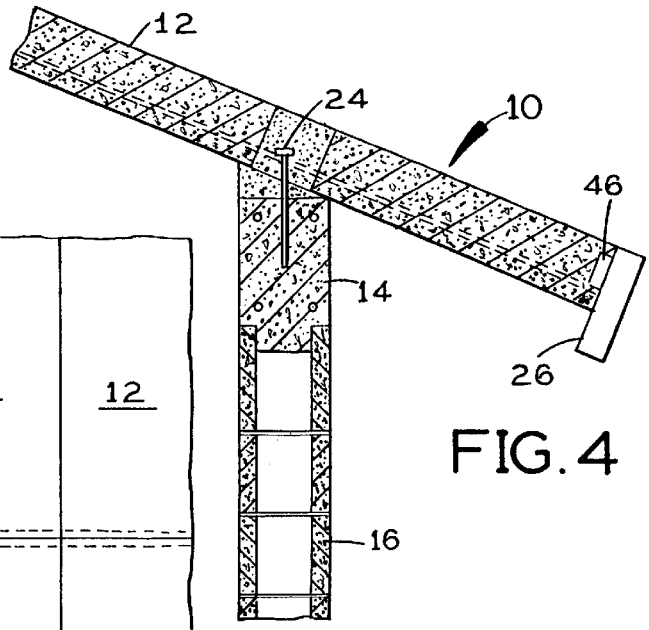
FIG. 4 is an elevational fragmentary view of a block wall supporting a tie beam, and a part of an overhanging concrete roof panel seen along line H—H of FIG. 2.

FIG. 2 shows a larger concrete roof 10 according to the invention, formed of modular concrete panels 12. Temperature reinforcing rods 24 are inserted in the roof panels 12 in direction transversely to the direction of the panels 12.

Although in some cases the use of a reinforcing fabric or rods 24 may not be structurally required, nevertheless it is contemplated that it will restrain the volumetric changes in the roof slab 12 due to changes in humidity and temperature, precluding the roof 10 from developing surface cracks that ultimately may be conducive to possible water leaks.

Precast fascia 26 are attached to the end of the precast roof panels 12 by temporary use of bolts. The line and level of the fascia 26 is accomplished by the use of piano wires attached to the corners of the roof 10. Similarly the lines generated at the roof ridge, hips and valleys are obtained. After the reinforcing mesh is in place, all lines are installed and the thickness of the topping is obtained, the system is ready for a secondary pour of cement.

In pouring the finishing concrete portion of the roof 10, the shotcrete method is used. The recommended mortar mixture should have a structural strength not higher than 3,000 psi. at 28 days. There are two main reasons for this. Cement is a man made material susceptible to relatively high volumetric changes due to humidity changes. The lesser the cement is to total volume ratio in a concrete mixture, the lesser volumetric changes will occur in the concrete after it reaches its final setting time. The second reason is its nailable capability. The higher the concrete strength, the harder it becomes attaching any roofing system to it if it has to be nailed. If, from a structural standpoint, no great bending or shear stresses are developed in the topping, then there is no reason to use high strength mortar mixture.

In order to prevent the slab 12 from developing thermal cracks during the curing process it is also recommended to add a proper amount of a non-shrinkable admixture to the mortar mixture be made. This will help secure the waterproofing qualities of the roof 10.

A secondary pour could be finished smooth or with a light brush texture.

Figure 5:
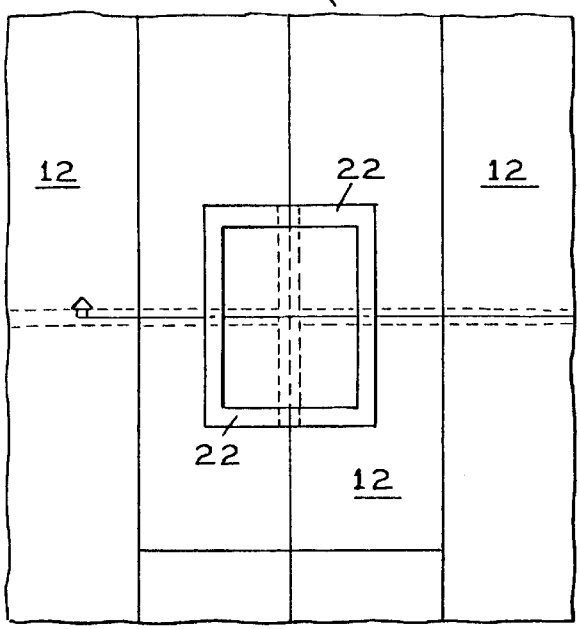
FIG. 5 is a fragmentary plan view of concrete roof panels, and field welded plate details welded to roof angles.
Figure 6:
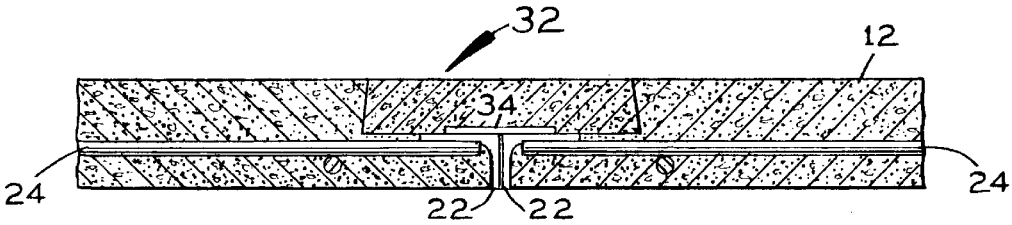
FIG. 6 is an elevational fragmentary detail cross-sectional view through a concrete roof panel seen along line F—F of FIG. 5.
Figure 7:
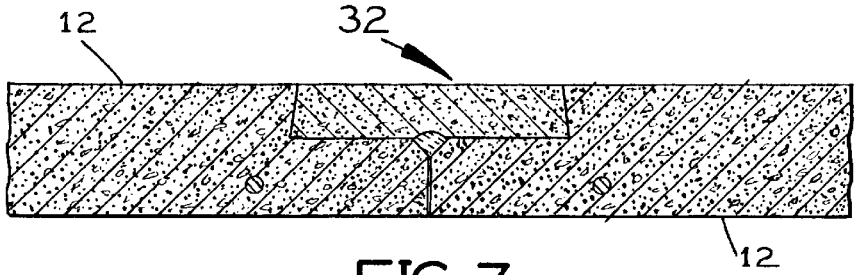
FIG. 7 is an elevational fragmentary detail, cross-sectional view through a concrete roof panel, seen along the line G—G of FIG. 5.

So far, a structural system has been described consisting of pre-stressed concrete panels 12 finished with a concrete topping has been described. In many cases it is not necessary to include a concrete topping in order to accomplish the same results. This would entail the elimination of the topping and in lieu of it, filling all the longitudinal joints 32 between panels 12, the valleys, the hips and the ridges with a proper low water cement ratio mortar as shown in FIG. 1. In addition there will be described two methods of temperature reinforcement seen in FIGS. 9 and 10. The temperature reinforcing rods 24 are necessary to eliminate all possible cracks in the surface of the concrete that may lead to water leakages. The FIG. 9 method shows the introduction of reinforcing steel bars 24 located transversely to the main span of the roof panels 12 in numbers and sizes sufficient to absorb any possible strain due to temperature and or humidity changes. The temperature reinforcement rods 24 are welded solidly to clip angles 22 located on each side of the panel 12 and connected to one another through a steel connecting plate 34 solidly welded to the clip angle 22, as seen in FIGS. 5 and 6.

Figure 8:
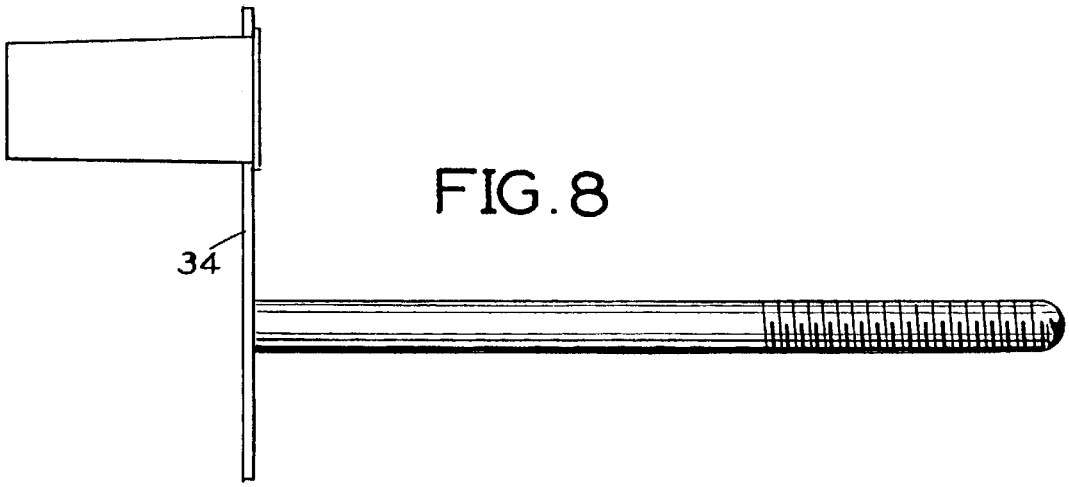
FIG. 8 is a cone-shaped accessory for retaining a plastic hose for post-tensioning a reinforcing cable.
Figure 9:
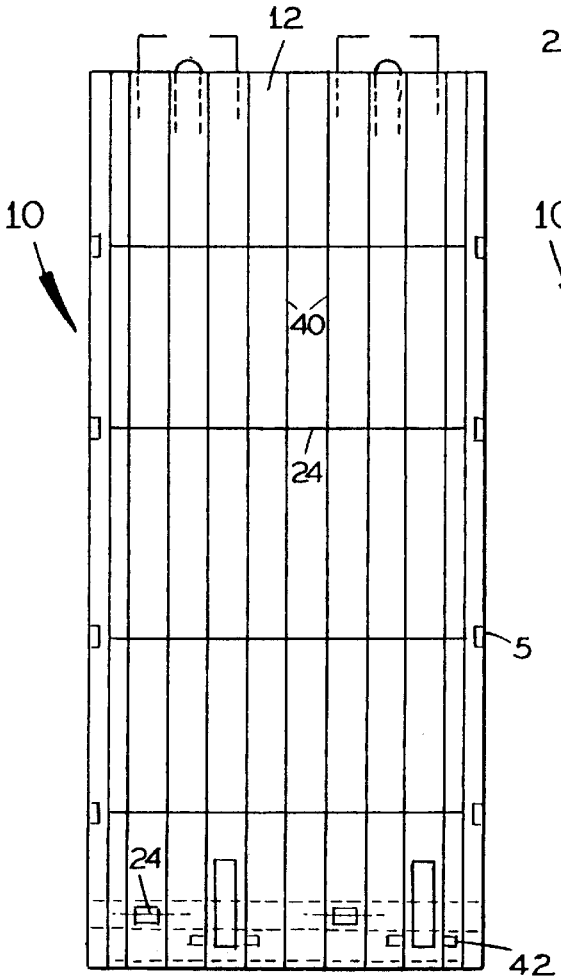
FIG. 9 is a top-down plane view of a prestressed concrete roof panel, prepared for future post-tensioning.
Figure 10:
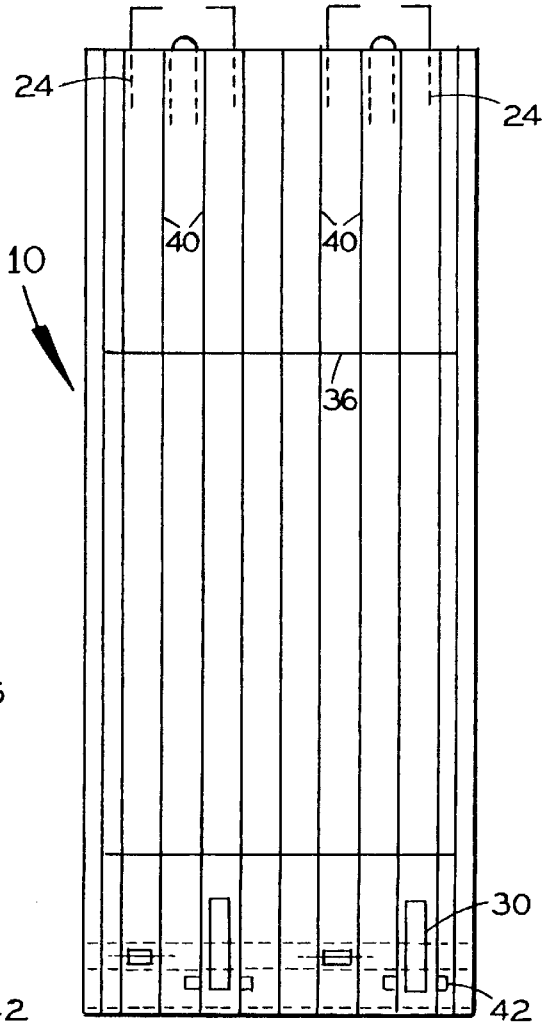
FIG. 10 is a top-down panel view of a prestressed concrete roof panel prepared for future post-tensioning.
Figure 11:
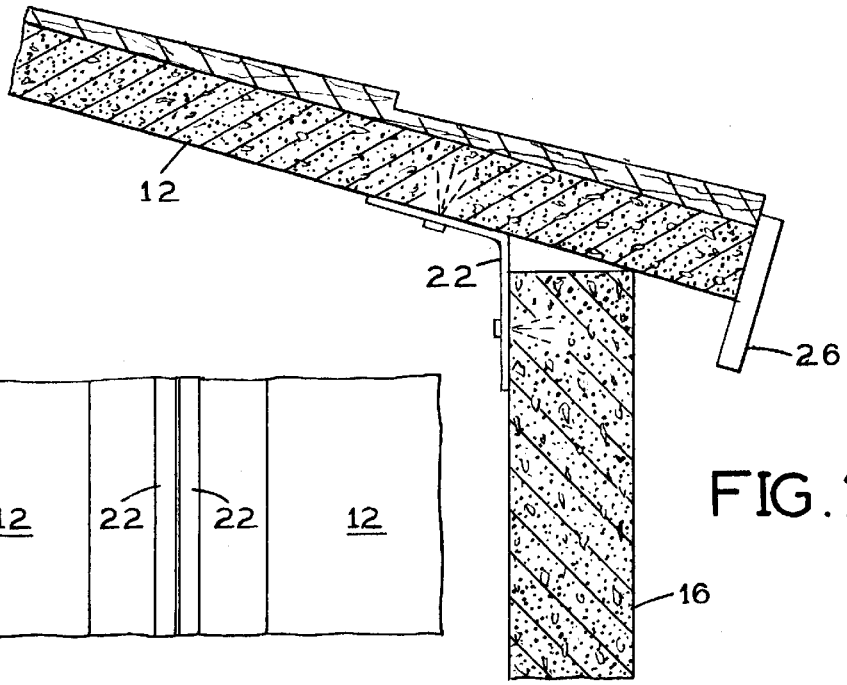
FIG. 11 is an elevational, fragmentary, cross-sectional view of a precast roof slab on a reinforced concrete wall and mounting detail.

The second method (FIG. 10) consists of embedding a plastic tube 36 using the accessory attachment, shown in FIG. 8, transversely through the concrete panels 12 and connecting them at the construction site with an additional plastic tube 36 located at the panel joints 32 and filling them in with a steel cable 40. After all joints 32, hips, valleys and ridges are filled to the final roof 10 lines and the proper strength is accomplished, then the temperature cables 40 are post-tensioned, cut and finished to surface with the proper amount of mortar. In this way the whole roof 10 surface is compressed to the point that no possible water leakage may result.

Figure 12:
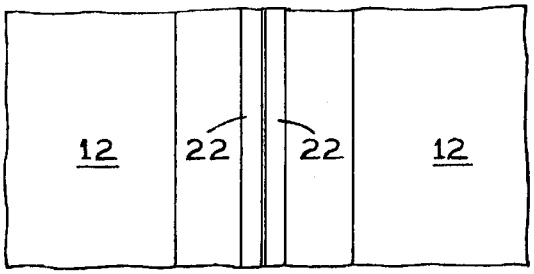
FIG. 12 is a partial plan view of a roof slab.
Figure 13:
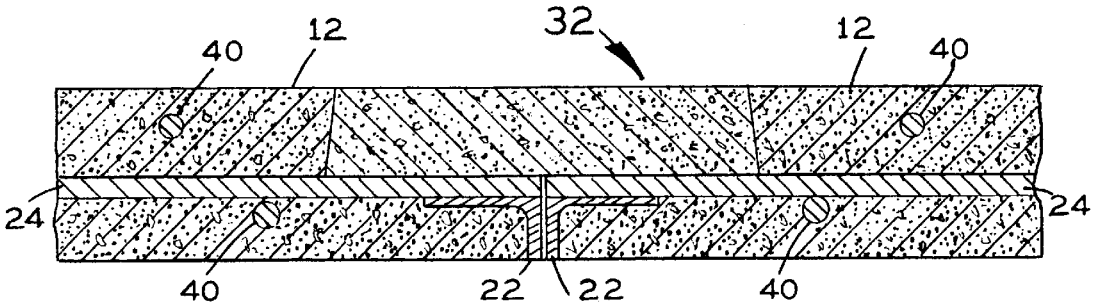
FIG. 13 s a cross-sectional view of the roof slab showing cables.
Figure 14:
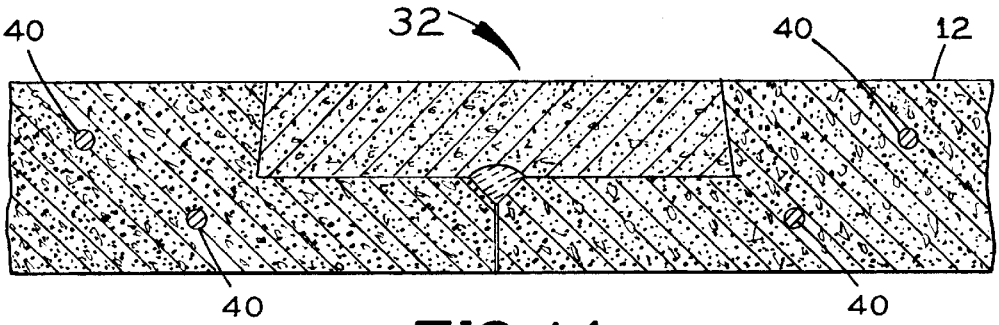
FIG. 14 is a cross-sectional view of the roof slab taken along line C of FIG. 12.

Horizontal thrust is provided by means of a diaphragm action of the roof panels 12 or of the entire concrete slab 12 in the poured-in-place method which generates a horizontal thrust that tends to reach into the strongest points of the wall system at the tie beam 14 level and which are located in general at the corner of the buildings. Depending on the size of the building, the tie beam 14 reinforcement may or may not carry this horizontal thrust. If necessary, the addition of post-tension cables 40 embedded in the tie beam 14 or of post-tension cables 40 between two adjacent and/or opposing building walls 16, panels and/or slopes of a poured-in-place concrete slab 12 will satisfy the strength requirement developed by the system. High strength cables 40 may be used for post-tensioning the whole roof 10 structure for uplift loads (FIGS. 12–14) that may be produced by a hurricane or tornado.

Ventilation of the attic space is accomplished by leaving an empty space (sleeve) (FIG. 3) at the underside of the roof panel 12 or of the poured-in-place concrete roof slab 12 that will connect the exterior of the building with the attic space. In order to be able to attach the corresponding screens to the underside of the overhang at the exterior wall of the building, inserts 42 of e.g. wood are left in the panel 12 so as to be able to attach the screen inserts 44 to them. See FIGS. 9 and 10.

There are two methods of attaching the fascia 26 member to the roof 10 system:

In buildings where the specifications call for attachment or use of a wood fascia 26, member, it may be attached to the roof 10 system by the use of a wood insert 46 at the edge of the overhang or of the entire perimeter in the case of the poured-in-place method, with nails and or screws.

In building with concrete fascias, their attachment to the roof 10 system may be accomplished by leaving threaded inserts along the edge of the roof panels and attaching the fascia to them through the use of bolts.

FIGS. 1*a*–1*d* are plan views of the monolithic poured-in-place concrete structure according to the third method with post-tension cables 40 complemented by steel reinforcement bars 24, and ventilation sleeves 30 connecting the inside with the outside of the building. FIG. 1*b* shows a plan view of the concrete structure poured-in-place according to the method with both transverse and longitudinal post-tension cables 40 and typical reinforcing steel 24 and with ventilation sleeves 30.

The entire roof area extending between the building outer walls 16 is formed either monolithically or in two or more sections, using plywood or preferably using permanent form material such as polystyrene which would provide the necessary permanent heat transfer insulation factor required by the energy code, and supported by heavy, adjustable post-shores (not shown) or other appropriate supporting structures. The overhang is supported during forming by the outside building walls 16, by separate post-shores, or by other structures. Steel reinforcement bars 24 and post-tension cables 40, as required, are laid from edge to edge of the perimeter longitudinally and/or transversely in such a way that the entire roof, including all hips and ridges is interconnected in compression.

In certain cases, the characteristics of the roof may require that some or all post-tension cables 40 not be post-tensioned from one edge of the poured-in-place slab 12 to the opposing edge. In these cases, the post-tension cables 40 will connect the edge of the slab 12, or any point in the slab 12 with another certain point in the slab 12 where there is a different plane or slope, or even within the same plane.

Steel reinforcing bars 24 protrude from the tie beam 14 or other supporting structure and are embedded in the poured-in-place concrete roof slab 12, creating a tie-down connection, and meeting the tie down requirements of the South Florida Building Code.

Wood or foam forms are placed, as required, along the overhang perimeter to create an empty space at the underside of the concrete roof slab 12. These forms create a ventilation sleeve 30, after the concrete is poured, extending between the outside of the building and the inside space, as shown in FIG. 3*a*. Screens 44 can later on be applied to the outside holes of this ventilation connection. Additional ventilation openings and/or provisions for skylights can be provided at the ridges or elsewhere, as desired.

Pressure treated wood inserts 46 are provided along the edge face of the perimeter of the overhang, as shown in FIG. 3A, to receive fasteners for attaching a traditional wood fascia with either screws or nails. High quality, minimum 3000 pound test concrete can be poured using the shot crete or the pump method, to form a monolithic connection between the entire roof area and the structural roof supporting system. In the case where the roof 10 is not formed and/or poured monolithically, all cold joints are filled with a low water-to-cement ratio concrete. After sufficient curing, proper tension is applied to all post-tension cables 40 and the supporting shoring is removed.

This poured-in-place post-tensioned method eliminates the expense incurred in welding, in the placement of empty tubes, of steel angles for attaching the concrete roof 10 to the tie beams 14, of pre-cast panel joints that may leak if not properly sealed, and eliminates the need for secondary pours. This method provides a totally water tight roof structure when properly designed and when transversely and longitudinally post-tensioned, so that cracks cannot develop on the surface of the concrete. Additional waterproofing may be provided by applying any number of asphalt-based or other types of sealers. A roof 10 system is provided according to any of the above descriptions, which is sealed, waterproofed or cured using Cemflex™ or Karrnac AF 220™. Foam insulation blocks 48 are optionally formed as part of panels 12.

I claim:

1. A roof system having a plurality of slopes for assembly on a building having building exterior walls, comprising:

roof end structures;

and a monolithic poured-in-place concrete roof slab comprising at least two non-coplanar sections defining at least one roof peak and a plurality of slab perimeter edges extending over said building exterior walls, a plurality of post-tension cables including a post-tension cable extending from a first perimeter edge to a second perimeter edge and crossing said peak for interconnecting multiple points of said roof system including hips and ridges in compression to prevent the formation of cracks and leaks.

2. A roof system according to claim 1, additionally comprising at least one cold joint.

3. A roof system according to claim 1, wherein at least one said post tension cable is secured between opposing slopes of said roof system.

4. A roof system according to claim 1, wherein said building has supporting walls and wherein at least one said post-tension cable is secured between at least one said slope and at least one said supporting wall of an opposing said slope.

5. A roof system according to claim 1, additionally comprising tie beams for supporting at least part of said roof system, and post-tension cables extending longitudinally with respect to said tie beams.

6. A roof system according to claim 1, additionally comprising roof system supporting means for supporting at least part of said roof system.

7. A roof system according to claim 1, comprising post-tension cables attached between roof system structures.

8. A roof system according to claim 1, additionally comprising ventilation sleeves extending outwardly at said roof system perimeter between said building exterior walls and said slab for enhancing air communication between the interior and the exterior of said building.

9. A roof system according to claim 1, additionally comprising sleeves extending across upper ends of said building exterior walls for ventilation at said slopes.

10. A roof system according to claim 1, additionally comprising openings for skylights.

11. A roof system according to claim 1, wherein said monolithic poured-in-place concrete roof slab additionally comprises an insulation foam block.

12. A roof system having a plurality of slopes for assembly on a building having building exterior walls, comprising:

roof end structures;

and a monolithic poured-in-place concrete roof slab comprising a plurality of slab perimeter edges extending over said building exterior walls, a plurality of post-tension cables including a post-tension cable extending from a first perimeter edge to a second perimeter edge for interconnecting multiple points of said roof system including hips and ridges in compression to prevent the formation of cracks and leaks.

13. A roof system having a plurality of slopes for assembly on a building having building exterior walls, comprising:

roof end structures;

and a monolithic poured-in-place concrete roof slab comprising at least two non-coplanar sections defining at least one roof peak and a plurality of slab perimeter edges at least one said perimeter edge extending over at least one said building exterior wall, a plurality of post-tension cables including a post-tension cable extending from a first perimeter edge to a second perimeter edge and crossing said peak for interconnecting multiple points of said roof system including hips and ridges in compression to prevent the formation of cracks and leaks.

14. A roof system having a plurality of slopes for assembly on a building having building exterior walls, comprising:

roof end structures;

and a monolithic poured-in-place concrete roof slab comprising at least two non-coplanar sections defining at least one roof valley and a plurality of slab perimeter edges at least one said perimeter edge extending over at least one said building exterior wall, a plurality of post-tension cables including a post-tension cable extending from a first perimeter edge to a second perimeter edge and crossing said valley for interconnecting multiple points of said roof system including hips and ridges in compression to prevent the formation of cracks and leaks.

* * * * *